US010315096B2

(12) United States Patent
Green et al.

(10) Patent No.: US 10,315,096 B2
(45) Date of Patent: Jun. 11, 2019

(54) ICE SKATE BLADE ARRANGEMENT

(71) Applicant: HD SPORTS LIMITED, Sheffield, South Yorkshire (GB)

(72) Inventors: Lewis Green, Sheffield (GB); Thomas Cantwell, Sheffield (GB); Liam Rains, Sheffield (GB); Adrian Pearce, Sheffield (GB); Patricia Ineson, Sheffield (GB)

(73) Assignee: HD SPORTS LIMITED, Sheffield (GB)

( * ) Notice: Subject to any disclaimer, the term of this patent is extended or adjusted under 35 U.S.C. 154(b) by 410 days.

(21) Appl. No.: 14/867,225

(22) Filed: Sep. 28, 2015

(65) Prior Publication Data

US 2017/0028291 A1 Feb. 2, 2017

(30) Foreign Application Priority Data

Jul. 30, 2015 (GB) ..... 1513467.9

(51) Int. Cl.
*A63C 1/32* (2006.01)
*A63C 3/02* (2006.01)
*A63C 1/30* (2006.01)

(52) U.S. Cl.
CPC ..... *A63C 3/02* (2013.01); *A63C 1/303* (2013.01); *A63C 1/32* (2013.01); *A63C 2203/20* (2013.01)

(58) Field of Classification Search
CPC .. A63C 1/30; A63C 1/303; A63C 1/32; A63C 1/16; A63C 1/17; A63C 17/061; A63C 17/062; A63C 17/0046
See application file for complete search history.

(56) References Cited

U.S. PATENT DOCUMENTS 47,185 A * 4/1865 Brigham ..... A63C 1/30 280/11.12
2,414,967 A * 1/1947 Meyers ..... A63C 1/02 280/11.14
2,424,819 A 7/1947 Guttridge
3,558,149 A 1/1971 Weidenbacker
5,085,445 A * 2/1992 Boyden ..... A63C 17/061 280/11.227
5,388,845 A * 2/1995 Soo ..... A63C 1/32 280/11.17
5,690,344 A * 11/1997 Chen ..... A63C 17/0046 280/11.224
5,769,434 A * 6/1998 Wurthner ..... A63C 1/30 280/11.12
5,855,383 A * 1/1999 Harr ..... A63C 17/0046 280/11.225

(Continued)

FOREIGN PATENT DOCUMENTS

GB 2477725 A 8/2011

OTHER PUBLICATIONS

Intellectual Property Office, Combined Search and Examination Report under Sections 17 and 18(3) to UK Patent Application GB1513467.9, dated Oct. 12, 2015, United Kingdom.

*Primary Examiner* — Emma K Frick
(74) *Attorney, Agent, or Firm* — NK Patent Law

(57) ABSTRACT

A blade arrangement for an ice skate boot, the blade arrangement comprising a support for an ice skate boot with a blade runner mounted to the support and a suspension structure arranged between the support and the blade runner.

9 Claims, 5 Drawing Sheets

(56) References Cited

U.S. PATENT DOCUMENTS 6,039,328 A * 3/2000 Pawlowski ..... A63C 1/30 280/11.12
6,105,975 A 8/2000 Shum
6,467,778 B1 * 10/2002 Goldsmith ..... A63C 1/00 280/11.12
6,485,033 B2 * 11/2002 Nicoletti ..... A63C 1/303 280/11.12
6,761,363 B2 * 7/2004 Fask ..... A63C 1/32 280/11.12
6,883,811 B2 * 4/2005 Tlucko ..... A63C 1/28 280/11.224
6,932,361 B2 * 8/2005 Steinhauser, Jr. ..... A63C 1/00 280/11.12
7,374,209 B2 * 5/2008 von Detten ..... A63C 1/30 280/11.115
7,673,884 B2 * 3/2010 Wuerthner ..... A63C 1/32 280/11.12
8,770,595 B2 * 7/2014 Cruikshank ..... A63C 1/22 280/11.14
8,857,823 B2 * 10/2014 Mars ..... A63C 1/28 280/11.15
9,186,569 B2 * 11/2015 Wuerthner ..... A63C 1/303
9,433,851 B2 * 9/2016 Dahlo ..... A63C 1/32
2002/0084601 A1 * 7/2002 Wu ..... A63C 1/22 280/11.115
2009/0056168 A1 * 3/2009 Tseng ..... A43B 3/24 36/100
2009/0085313 A1 4/2009 Landry
2009/0224494 A1 * 9/2009 Wan ..... A63C 1/32 280/11.18
2009/0273148 A1 * 11/2009 Wan ..... A63C 1/32 280/11.18
2011/0001297 A1 * 1/2011 Labonte ..... A63C 1/32 280/11.12
2013/0285338 A1 10/2013 Blois
2015/0091263 A1 * 4/2015 Lewis ..... A63C 17/06 280/11.223
2016/0114239 A1 * 4/2016 Davis ..... A63C 1/303 280/11.12
2018/0185735 A1 * 7/2018 Labonte ..... A63C 1/32

* cited by examiner

ICE SKATE BLADE ARRANGEMENT

CROSS-REFERENCE TO RELATED APPLICATIONS

This application claims priority to United Kingdom Patent Application No. 1513467.9 filed on Jul. 30, 2015, the entire contents of which are incorporated by reference herein.

TECHNICAL FIELD

This disclosure relates to a blade arrangement for an ice skate boot.

BACKGROUND TO THE INVENTION

A blade arrangement for an ice skate boot typically consists of a support, which provides one or more flat surfaces for attaching to the sole and heel portion of the boot to support its weight, and a blade runner, which is mounted to the support and engages the ice when the ice skate boot is in use.

For figure skating particularly, it is desirable to have a lightweight ice skate, to make it easy for a user to move about freely and perform jumps etc. Traditionally, blade arrangements have been made from steel. More recently, blade arrangements have been made from aluminium and titanium to help keep the weight of the skates low. However, it has been found these skates may be noisier in use and can give a relatively harsh ride over the ice. In addition, they can provide little protection from impact injuries. This has become a greater issue in recent years as the sport has developed; the jumps performed in competitive figure skating becoming increasingly high, resulting in greater impact forces on landing. Other blade arrangements have been manufactured using carbon fibre, and although they perform well, these can be costly and complex to manufacture.

SUMMARY OF THE INVENTION

According to a first aspect of the invention, there is provided a blade arrangement for an ice skate boot, the blade arrangement comprising a support for an ice skate boot; a blade runner mounted to the support; and a suspension structure arranged between the support and the blade runner.

The suspension structure helps to provide cushioning, to improve the ride of the boot, lower noise, and lower the risk of impact injuries in use.

The suspension structure may comprise a resilient element.

The resilient element may be formed of an elastomeric material.

This provides a durable, low cost, low noise way of providing a suspension.

The spring rate of the material of the resilient element may vary along its length.

This enables the suspension to be tuned to provide particular support at particular locations.

The shore hardness value of the material of the resilient element may vary along its length.

The resilient element may be elongate and may extend generally along the length of the blade runner.

This allows for suspension along the full length of the blade runner.

The resilient element may be in contact with the support and the blade runner along at least a portion of its length.

This spreads the loading along the length of the blade runner.

The resilient element may be in contact with the support and the blade runner along its entire length.

This further spreads loading along the length of the blade runner.

The resilient element may be a continuous strip.

As it is one piece, assembly of the blade arrangement is simple.

The blade runner may be removably mounted to the support.

This allows removal of the blade runner for replacement, maintenance or repair.

The support may comprise a longitudinal slot in a bottom surface.

This provides a simple way of fitting blade runner to the support.

The blade runner and the support may each comprise one or more apertures, wherein each aperture of the support is configured to align with one of the apertures of the blade runner, and the blade arrangement may further comprise one or more fastening members, the fastening members passing through the apertures of the blade runner and the apertures of the support to mount the blade runner to the support.

This provides a simple, reliable way of holding the blade runner to the support.

The blade runner may comprise one or more projecting portions that extend from a top surface of the blade runner and one or more recessed portions located between the projecting portions, along the length of the blade runner.

At least a portion of the projecting portions of the blade runner may be configured to fit in the slot.

The projecting portions of the blade runner may be lugs, and one of the apertures of the blade runner may be located in each lug, so each aperture of the blade runner aligns with an aperture of the support when the lugs are located in the slot.

This provides a strong surround to the aperture through which a fastening member may be fitted.

The suspension structure may comprise one or more resilient sleeves, each resilient sleeve being located in one of the apertures of the blade runner and/or the support, the resilient sleeve being configured to surround at least a portion of one of the fastening members.

Each sleeve help to provide resilience to the suspension structure, either on its own or to augment the resilient element.

The resilient sleeves may be cylindrical bushes.

The resilient sleeves may be formed of an elastomeric material.

The resilient sleeves may be polyurethane.

The resilient sleeves may be integral with the resilient element.

The resilient element may be an elongate strip, and the blade arrangement may further comprise one or more linking portions that connect the resilient element to the resilient sleeves, wherein the blade runner comprises one or more cut-out sections for locating the linking portions.

This enables a complete single piece suspension structure.

The suspension structure may comprise a plurality of discrete resilient portions.

This may provide for simpler manufacturing of the suspension structure.

Each discrete portion may be an elongate strip.

Each discrete strip portion of the suspension structure may be located in a recessed portion of the blade runner.

This may help locating of the strip portion during assembly and help it to retain its position in use.

The suspension structure may comprise polyurethane.

DESCRIPTION OF EMBODIMENTS

Figure 1:
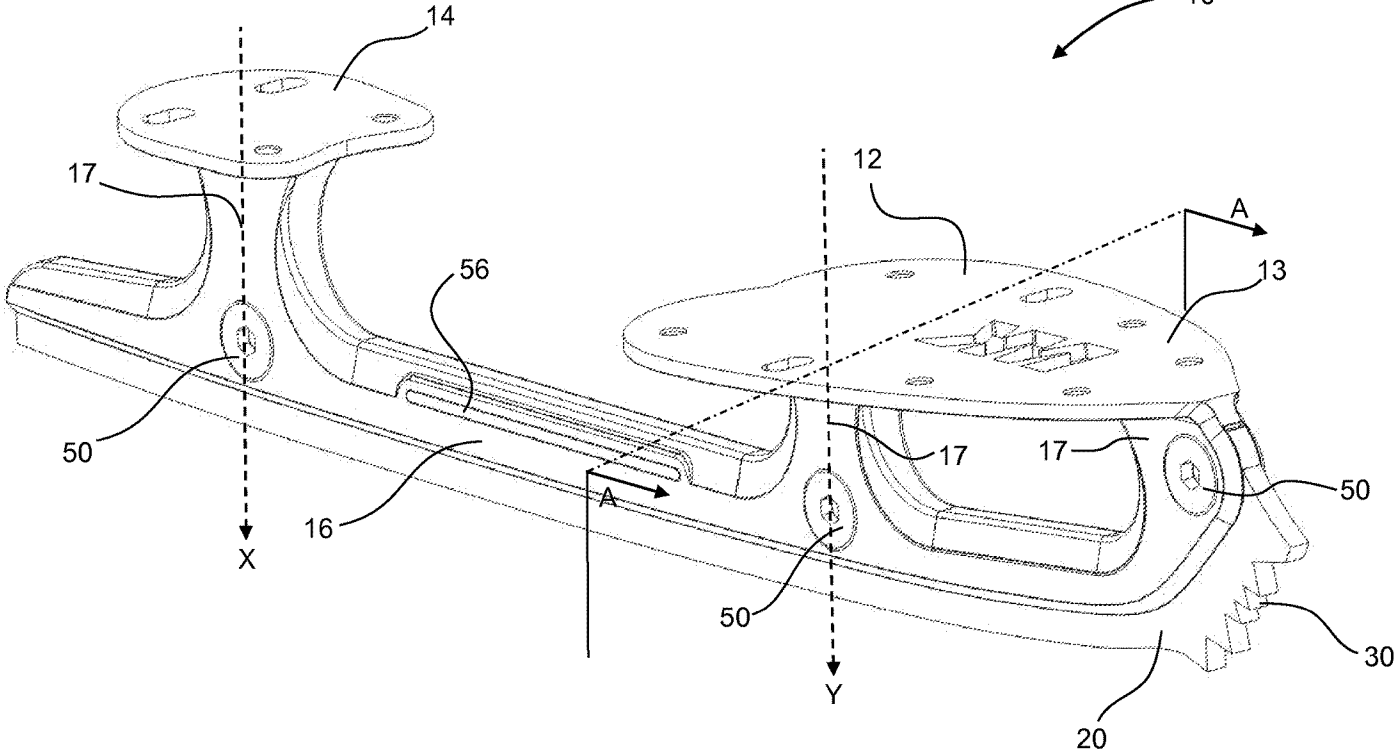
FIG. 1 is a perspective view of a blade arrangement for an ice skate boot according to a first embodiment of the invention.
Figure 2:
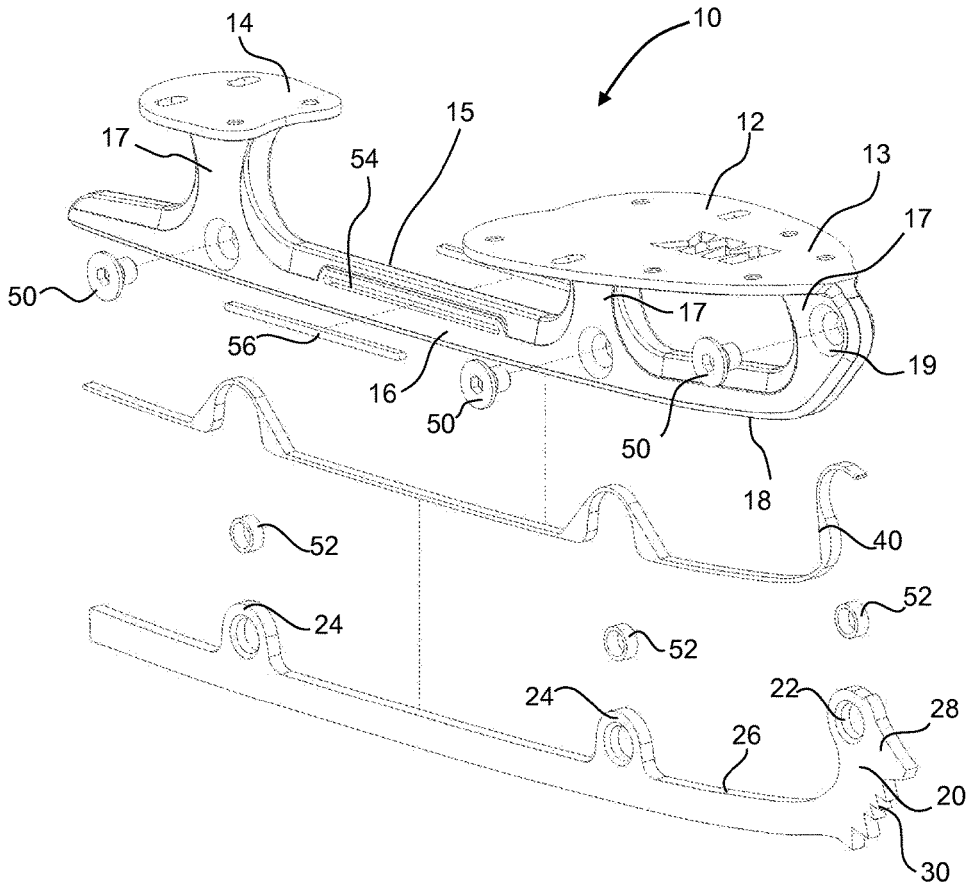
FIG. 2 is an exploded perspective view of the blade arrangement of FIG. 1.

Referring firstly to FIGS. 1 and 2, a blade arrangement for an ice skate boot is indicated generally at 10. The blade arrangement 10 is made up of a support 12 for attaching to the sole of an ice skate boot (not shown), a blade runner 20 mounted to the support 12, and a suspension structure arranged between the support 12 and the blade runner 20. The suspension structure includes a resilient element 40, which is arranged between the support 12 and the blade runner 10.

Figure 3:
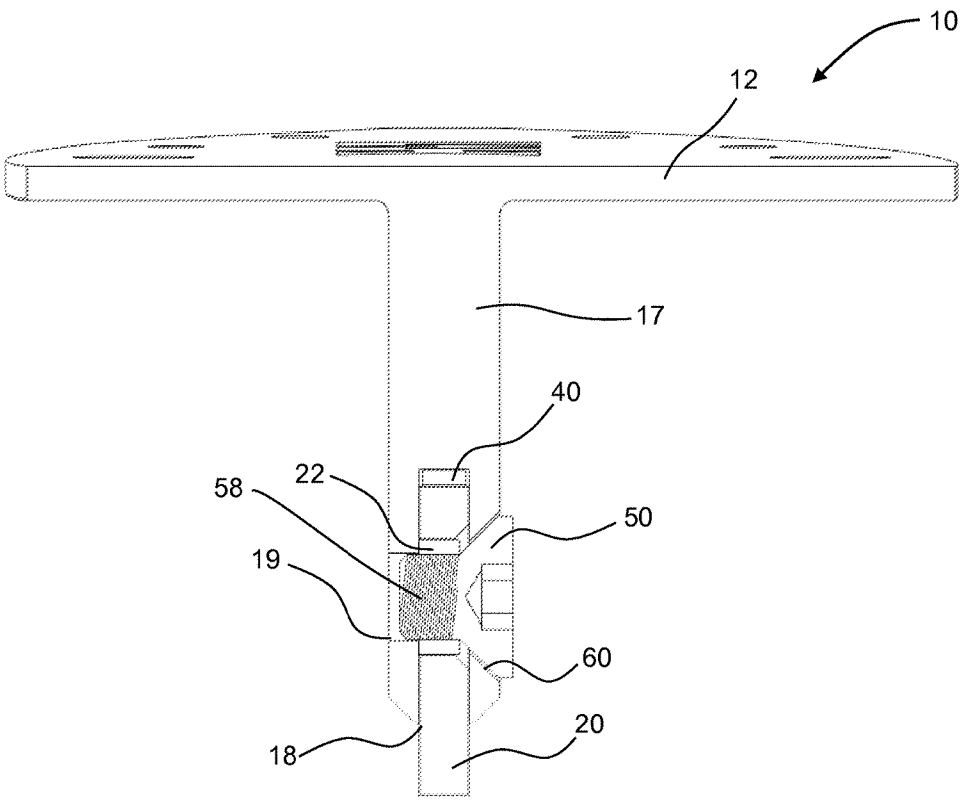
FIG. 3 is a cross-sectional view of the blade arrangement of FIG. 1, taken through the plane A-A.
Figure 4:
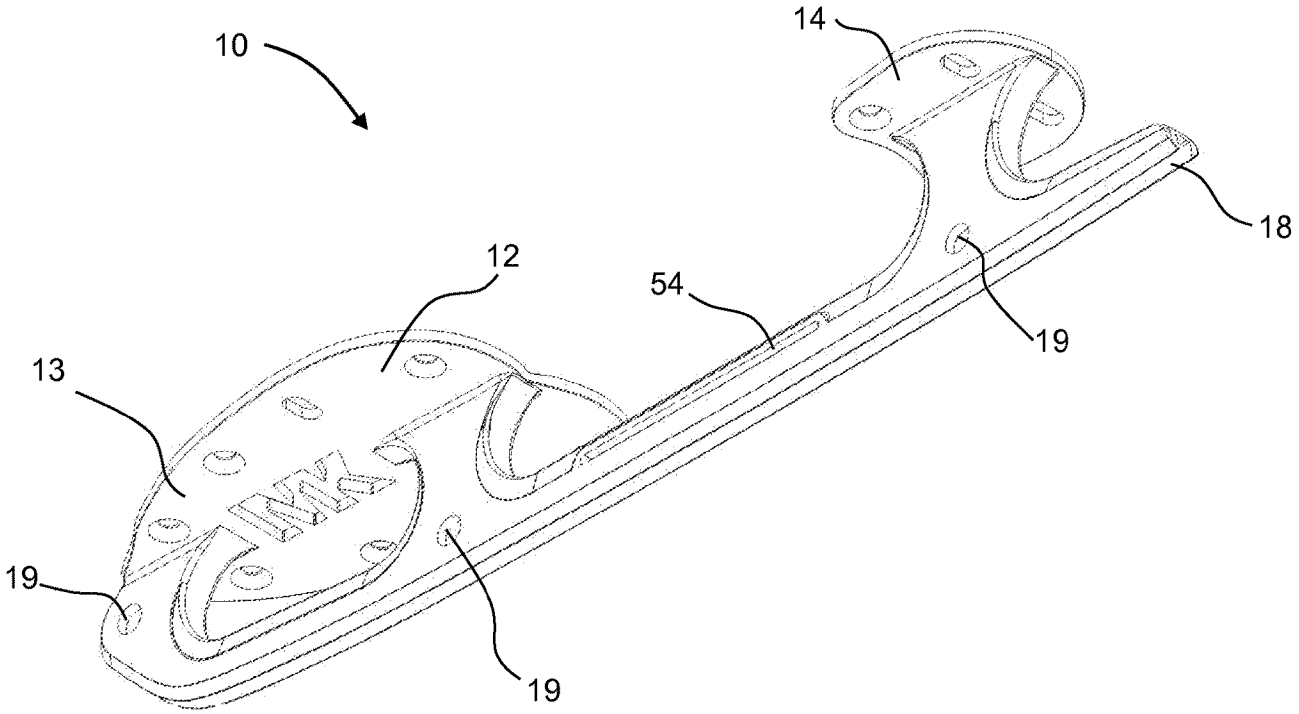
FIG. 4 is a perspective view of an underside of a support of the blade arrangement of FIG. 1.

The support 12 is generally made up of a front portion 13 and a rear portion 14, connected by a bridge portion 15. The front portion 13 and rear portion 14 are generally planar surfaces, dimensioned and shaped to contact the sole of an ice skate boot, so the ice skate boot can be attached to the support 12. Typically, the front and rear portions 13, 14 include a plurality of holes, so fastening members can be used to secure the support 12 to the sole of an ice skate boot. The bridge portion 15 is made up of an elongate body portion 16 which is connected to the front and rear portions 13, 14 by a plurality of arms 17. In this embodiment, the rear portion 14 is connected to the body portion 16 by one arm 17, and the front portion 13 is connected to the body portion 16 by two arms 17. The body portion 16 has a longitudinal slot 18 in a bottom surface, the longitudinal slot 18 extending generally along the entire longitudinal length of the support 12. As can be seen most clearly in FIG. 3, the longitudinal slot 18 defines a recess within the support 12 that extends upwardly from the bottom surface of the body portion 16 of the support 12. The recess is dimensioned so that it can locate the resilient element 40, as well as at least a portion of the blade runner 20. As can be seen from FIG. 3, the resilient element 40 is located between the support 12 and the blade runner 20, a top surface of the resilient element 40 contacting the support 12 and a bottom surface of the resilient element 40 contacting the blade runner 20. The support 12 includes a plurality of apertures 19 arranged along the length of the support 12. In this embodiment, the apertures 19 are arranged to be generally at the junctions between the arms 17 and the body portion 16. Locating the apertures in these positions allows room for the thickness of the resilient element 40 to be increased if desired, e.g. to increase shock absorption.

The support 12 is typically manufactured from aluminium. In this embodiment, it is extruded from a T-section billet of aluminium before being finished. It will be appreciated, however, that the support 12 can be made of any appropriate material that is strong and relatively lightweight, such as titanium, magnesium alloy, carbon fibre etc. It can also be manufactured in any appropriate way, e.g. by casting, machining, forging etc.

The blade runner 20 is generally elongate, and extends for a length that is approximately equal to the length of the longitudinal slot of the support 12. It is typically formed from stainless steel, but can be formed of any appropriate material for a blade; a light-weight alloy such as carbon steel, titanium or magnesium alloy, or a ceramic material, for example. The blade runner 20 is made up of a generally straight rear portion 26 and a front portion 28 projecting generally upwardly, in a perpendicular direction from the rear portion 26. The front portion 28 has an angled front surface 30, typically at about 45 degrees to the rear portion 26, which has a plurality of teeth projecting from it. This angled front surface 30 defines a 'toe pick' that is used in figure skating to engage the ice to help perform certain jumps, for example. The blade runner 20 also includes projecting portions that extend from a top surface of the blade runner 20 and one or more recessed portions located between the projecting portions, along the length of the blade runner. In this embodiment, the projecting portions are in the form of three rounded lugs 24. The lugs are configured to fit in the longitudinal slot 18 of the support 12, when the blade runner 20 is mounted to the support 12.

In this embodiment, the blade runner 20 is removably mounted to the support 12. This enables the blade runner 20 to be removed and replaced with a new blade runner by a user when the blade runner 20 becomes worn. Alternatively, the blade runner 20 could be temporarily removed and sharpened before being remounted on the support 12. It will be appreciated however, that the blade runner 20 may be permanently mounted to the support, e.g. by an arrangement including adhesive, an arrangement including welding, or an arrangement including permanent fastening members, e.g. rivets. This may be of application to enable cost-effective versions of ice skate boots to be manufactured at a lower price, to be targeted at less advanced recreational ice skaters, who may not require a replaceable blade.

The blade runner 20 comprises apertures 22 that extend transversely through the blade runner 20. The apertures 22 are distributed along the length of the blade runner 20. Each aperture 22 is located in a different lug 24. It can be seen that the lugs 24 are located so that the longitudinal location of the apertures 22 of the blade runner 20 generally corresponds to the longitudinal location of the apertures 19 of the support 12, so that when the lugs 24 are inserted in the longitudinal slot 18 to mount the blade runner 20 to the support 12, the apertures 19 of the support 12 are aligned with the apertures 22 of the blade runner 20.

The blade arrangement 10 also includes one or more fastening members, each fastening member passing through one aperture 19 of the support 12 and through one aperture 22 of the blade runner 20, to mount the blade runner 20 to the support 12.

In this embodiment, the fastening members are screws 50, but any appropriate arrangement could be used to secure the blade runner 20 to the support 12, e.g. a nut and bolt arrangement, rivets, grub screws, or projections provided on one of the components arranged to engage corresponding recesses on the other component. The apertures 19 of the support 12 include a threaded inner surface (not shown). As can be seen from FIG. 3, the screws 50 have a corresponding threaded surface 58 that engages the threaded inner surface of the aperture 19 to mount the blade runner 20 to the support 12. A stop is also provided, to prevent over-tightening of the screws 50. In this embodiment, the stop is a seat 60 that is located in each aperture 19 of the support 12. The seat 60 has a tapered inner surface defining a generally frusto-conical recess that locates the head of the screw 50. The seat 60 prevents the screw 50 from being tightened past a defined point, as a surface of the head of the screw 50 engages the inner surface of the seat 60, and any further movement of the screw 50 through the aperture 19 is prevented. Alternatively, a shoulder could be provided within the aperture 19 to limit the screw movement, or the stop could be a separate component that fits within each aperture 19 of the support 12, and/or each aperture 22 of the blade runner 20, to prevent over-tightening of the screws 50. In this embodiment, the screws 50 engage a threaded inner surface of the apertures 19 of the support 12, but it will be appreciated that a threaded surface could alternatively be provided on the inner surface of the apertures 22 of the blade runner 20. The screw may be secured with a locking compound to inhibit loosening.

In this embodiment, the resilient element 40 is elongate and extends generally along the length of the blade runner 20. In this embodiment, the resilient element 40 is a continuous strip. The resilient element 40 is in contact with the support 12 and the blade runner 20 along its entire length, being located in the recess defined by the longitudinal slot 18 of the support 12. The resilient element is shaped to correspond to the profile of the upper surface of the blade runner 20, e.g. in this embodiment it has curved portions that correspond to the projecting lugs 24 of the blade runner 20. This helps to ensure a close fit of the resilient element 40 to the blade runner 20, and enables force to be transmitted along its entire length in use.

In this embodiment, the resilient element 40 is formed of an elastomeric material, such as a thermoplastic polymer. Use of an elastomeric material, that is able to resume its original shape when a deforming force is removed, enables the resilient element to act as a shock absorber, increasing the comfort of the ice skate boot in use, and helping to prevent impact injuries. Polyurethane has been found to be a particularly advantageous material, as it can be easily manufactured to the desired shape by, for example, injection moulding. Also, polyurethane is very durable relative to e.g. rubber, and has noise abatement properties.

The material used can be chosen so that the 'spring rate' of the resilient element 40 can be varied along the length of the resilient element 40 as desired. The spring rate is defined as the amount of deflection permitted, e.g. if a force of x is applied, the material compresses a distance y. The spring rate is x/y. Therefore, a higher spring rate means less deflection, and so a less 'springy' material. The amount of 'springiness' of the material can also be defined by its shore hardness value, i.e. the shore hardness value can vary along the length of the resilient element 40. Typically, to achieve an appropriate amount of cushioning in the ice skate blade arrangement, the resilient element is manufactured using a material with a shore hardness value in the range of 60-90, on the 'A' scale.

As an example, a first portion of the resilient element 40 could be made from a material with a first spring rate (or shore hardness), and a second portion of the resilient element 40 could be made from a material with a second spring rate (or shore hardness). The first spring rate may be higher than the second spring rate, i.e. the first portion of the resilient element 40 does not deflect as far when compressed as the second portion of the resilient element 40. The differing materials could be, for example, two differing grades of polyurethane.

The thickness of the material used may be varied along the length of the resilient element 40, so the maximum deflection and/or the spring rate would vary along the length of the resilient element 40. The varying thickness may be combined with varying material.

Polyurethane is also advantageous due to its thermal resistance properties. When heat is introduced into the blade arrangement during sharpening of the blade runner, the resilient element should not deform.

The suspension structure of the blade arrangement 10 may also include one or more resilient sleeves 52. The resilient sleeves 52 are located between the screws 50 and the inside walls of the apertures 22 of the blade runner 20 and the apertures 19 of the support 12, when the blade arrangement 10 is assembled. Each resilient sleeve 52 is configured to surround at least a portion of one of the screws 50. In this embodiment the resilient sleeves 52 surround the body of the screws 50. Each resilient sleeve 52 is generally cylindrical, with a through bore for receiving the body of a screw 50. Each resilient sleeve 52 acts as a bush between the screws 50 and the support 12 and/or the blade runner 20. The resilient sleeves 52 are made from an elastomeric material. Preferably, like the resilient element 40, the material is a thermoplastic polymer that can be easily moulded, such as polyurethane.

Therefore, it can be seen that the resilient sleeves 52 act as further cushioning within the blade arrangement 10, helping to dampen the forces that pass through the blade arrangement 10 in use, to provide improved comfort and lower the risk of an impact injury. In this embodiment, the resilient sleeves 52 and the resilient element 40 are both provided, but it will be appreciated that the suspension structure may include solely the resilient sleeves 52, without the resilient element 40. This would still be advantageous, and provide a level of cushioning.

Alternatively, the resilient sleeves 52 can be made integral with the resilient element 40 (not shown). In this arrangement, one or more linking portions are provided that connect the resilient element 40 to the resilient sleeves 52. The blade runner 20 includes one or more cut-out sections to provide a path for locating the linking portions.

The body portion 16 of the support 12 also includes one or more longitudinal recesses 54 extending along a side face of the body portion 16 of the support 12. A corresponding resilient strip 56 is located within each recess 54. The resilient strip 56 is dimensioned to fit in the recess 54 and is formed of the same material as the resilient element 40 and/or the resilient sleeves 52. It is intended to be used as branding for the ice skate, to help advertise the cushioning aspect of the product.

Figure 5:
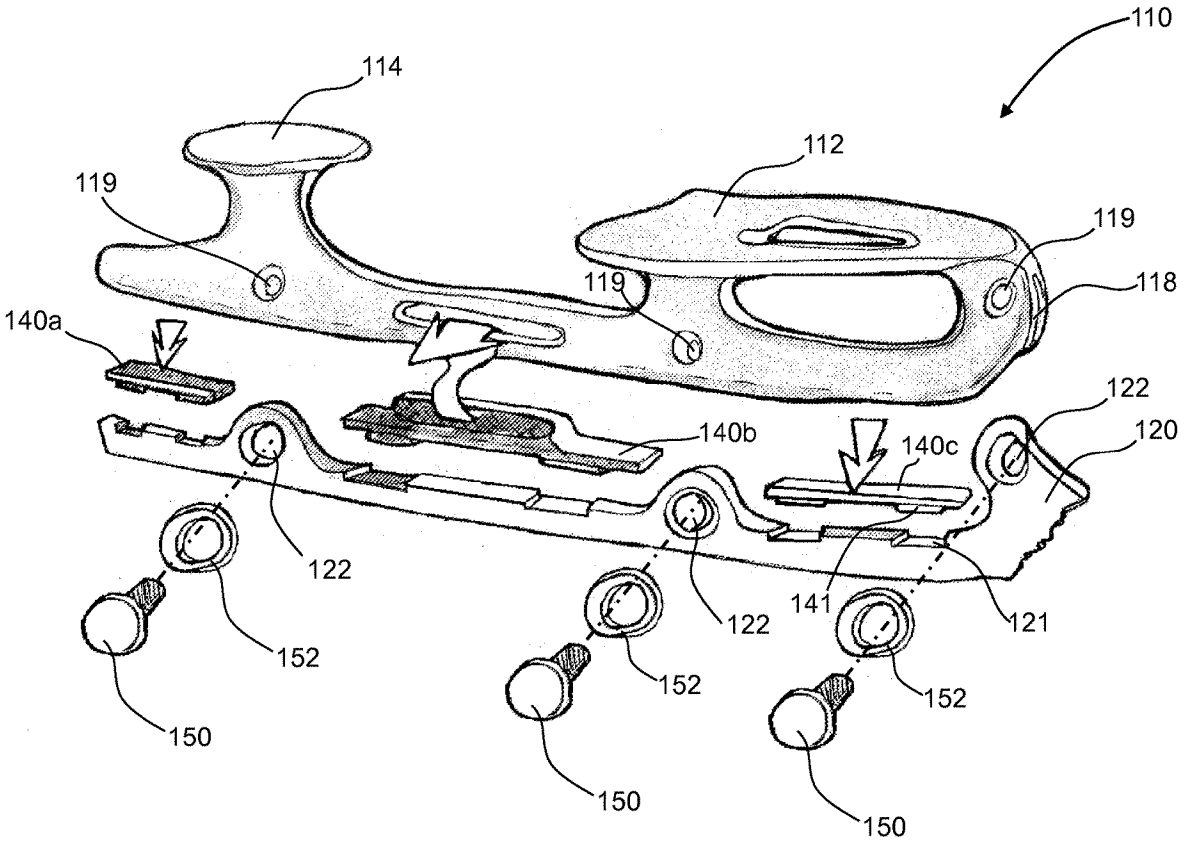
FIG. 5 is an exploded perspective view of a blade arrangement for an ice skate boot according to a second embodiment of the invention.

FIG. 5 shows an alternative blade arrangement 110. (Features that correspond to the blade arrangement 10 have like numbers, but with the suffix '100'). In this arrangement, the suspension structure includes a plurality of discrete resilient portions 140*a*, 140*b* and 140*c*, instead of the one-piece resilient element 40. Each discrete portion 140*a*, 140*b*, 140*c* is an elongate strip. Each discrete portion 140*a*, 140*b*, 140*c* is located in one of the recessed portions of the blade runner 120. When assembled, the discrete portions 140*a*, 140*b*, 140*c* are located either side of a lug 124 of the blade runner 120, so it is not necessary to include curved portions, as is necessary for the one-piece resilient element 40, because the resilient element 40 is required to fit over the profile of the blade runner 20. The blade runner 120 includes channels 121 in its upper surface, for receiving projections 141 that extend from a bottom surface of the discrete portions 140*a*, 140*b*, 140*c*. The engagement of the projections 141 and the channels 121 helps to limit relative movement of the discrete portions 140*a*, 140*b*, 140*c* and the blade runner 120.

Although the invention has been described above with reference to one or more preferred embodiments, it will be appreciated that various changes or modifications may be made without departing from the scope of the invention as defined in the appended claims. For example, the suspension structure may be manufactured, at least in part, from non-elastomeric structures such as leaf springs or fluid dampers, either in isolation or in conjunction with elastomeric material.

In a variant, one or more holes are drilled through the support of the blade arrangement to further save weight. As an example, see FIG. 1, where arrows X and Y indicate the direction that holes could be drilled from the top faces of the support 12 and down into the support 12, to remove material and reduce weight. In this embodiment, the holes may be blind bores, but it will be appreciated that in other embodiments, holes may be formed in the support that pass all the way through the support.

In a further variant, the resilient sleeves 52 are of varying radial thicknesses. For example, the rear resilient sleeve (i.e. the resilient sleeve that is located directly under the heel of the boot in use) is of an increased radial thickness relative to the front resilient sleeves (i.e. the resilient sleeves that are located under the front part of the boot in use). This enables the amount of shock absorption to be varied throughout the shoe. In the example above, it can be seen that the amount of suspension at the rear of the boot would be greater than the amount of suspension at the front of the boot, which may be advantageous as the amount of force that is passed from the boot to the blade arrangement in use can vary between the front and the back.

What is claimed:

1. A blade arrangement for an ice skate boot, the blade arrangement comprising:

a support for the ice skate boot, the support comprising a longitudinal slot in a bottom surface, the slot extending generally along the entire longitudinal length of the support;

a blade runner mounted to the support; and a suspension structure arranged between the support and the blade runner, the suspension structure being separable from the support and the blade runner, the suspension structure comprising an elongate resilient element, the resilient element extending generally along the length of the blade runner, wherein a top surface of the resilient element is in contact with an upper surface of the slot of the support, and a bottom surface of the resilient element is in contact with the blade runner, along the entire length of the resilient element, wherein the resilient element is encased by the support and the blade runner when the blade runner is installed to and engaged with the support.

2. The blade arrangement of claim 1, wherein the resilient element is formed of an elastomeric material.

3. The blade arrangement of claim 1, wherein a spring rate of the material of the resilient element varies along its length.

4. The blade arrangement of claim 1, wherein a shore hardness value of the material of the resilient element varies along its length.

5. The blade arrangement of claim 1 wherein the resilient element is a continuous strip.

6. The blade arrangement of claim 1, wherein the blade runner and the support each comprise one or more apertures, wherein each aperture of the support is configured to align with one of the apertures of the blade runner, the blade arrangement further comprising one or more fastening members, the fastening members passing through the apertures of the blade runner and the apertures of the support to mount the blade runner to the support.

7. The blade arrangement of claim 6, wherein the blade runner comprises one or more projecting portions that extend from a top surface of the blade runner and one or more recessed portions located between the projecting portions, along the length of the blade runner, wherein at least a portion of the projecting portions of the blade runner are configured to fit in the slot.

8. The blade arrangement of claim 1, wherein the suspension structure comprises polyurethane.

9. In a blade arrangement for an ice skate boot that includes a support for the ice skate boot, the support comprising a longitudinal slot in a bottom surface, the slot extending generally along the entire longitudinal length of the support, and a blade runner mounted to the support, a suspension structure arranged between the support and the blade runner, the suspension structure being separable from the support and the blade runner, the suspension structure comprising an elongate resilient element, the resilient element extending generally along the length of the blade runner, wherein a top surface of the resilient element is in contact with an upper surface of the slot of the support, and a bottom surface of the resilient element is in contact with the blade runner, along the entire length of the resilient element, wherein the resilient element is encased by the support and the blade runner when the blade runner is installed to and engaged with the support.

* * * * *